US006185748B1

(12) United States Patent
DeChambeau

(10) Patent No.: US 6,185,748 B1
(45) Date of Patent: Feb. 13, 2001

(54) BILLED CAP WITH ELASTICIZED SUNGLASS HOLDER

(76) Inventor: David DeChambeau, 134 Peabody St., Gardner, MA (US) 01440

( * ) Notice: Under 35 U.S.C. 154(b), the term of this patent shall be extended for 0 days.

(21) Appl. No.: 09/466,147

(22) Filed: Dec. 17, 1999

(51) Int. Cl.[7] ..... A42B 1/00
(52) U.S. Cl. ..... 2/195.1; 2/209.13; 224/181; 351/155
(58) Field of Search ..... 2/171, 209.12, 2/209.13, 195.1, 209.14, 175.1, 13, 918, 12; 128/857; 224/181; 351/155, 52

(56) References Cited

U.S. PATENT DOCUMENTS 4,179,753 * 12/1979 Aronberg et al. ..... 2/10
4,606,453 * 8/1986 Burns ..... 206/5
5,102,024 * 4/1992 Boersma et al. ..... 224/181
5,491,841 * 2/1996 Valletta ..... 2/10
5,491,842 * 2/1996 Braswell-Moore ..... 2/10
5,567,038 * 10/1996 Lary ..... 362/106
5,647,061 * 7/1997 Marcus ..... 2/11
5,860,167 * 1/1999 Lizio ..... 2/209.13

* cited by examiner

*Primary Examiner*—John J. Calvert
*Assistant Examiner*—Katherine M Moran
(74) *Attorney, Agent, or Firm*—Mark P. White

(57) ABSTRACT

A billed cap with integrated sunglass holder has a band of elasticized fabric which lies on the superior surface of the bill. The band is about 1⅞ inches in width, and has a first end and a second end. The first end is attached to the anterior edge of the bill by folding the first end over the anterior edge and sewing it to the inferior surface of the bill close to the anterior end. The second end of the band is sewn into the seam which attaches the posterior edge of the bill to the cap body. The band is slightly stretched when sewn onto the bill in this manner, so that the band is unobtrusive when not containing the sunglasses.

5 Claims, 4 Drawing Sheets

BILLED CAP WITH ELASTICIZED SUNGLASS HOLDER

BACKGROUND OF THE INVENTION

1. Field of the Invention

The present invention relates to wearing apparel having means to attach sunglasses, and more particularly, billed caps with built-in sunglass holders.

2. Description Relative to the Prior Art

Sunglasses are a feature of modem outdoor life. They may be prescription or non-prescription types, but in either event wearers frequently put on their sunglasses and remove them again. When entering a darkened building from the outside, for instance, sunglasses may hinder the wearer's eyesight. Upon leaving the building, the wearer may want to put the sunglasses back on again, as the sudden change in light level can cause discomfort for the wearer.

Manufacturers of sunglasses usually provide cases for carrying the sunglasses when they are not being worm. Repeatedly inserting the glasses in the case and then removing them can be annoying for the wearer. In addition, the wearer may have to carry the sunglass case in his pocket, in the case or a male wearer, or a female not carrying a handbag. The case can cause damage to the wearer's pocket, or cause unfashionable bulges in the wearer's body line. Or the wearer may not be wearing a garment with pockets.

In any of the above cases, it is desirable to have an alternative means of carrying the sunglasses when they are not being worn.

The prior art provides a number of different approaches to this problem. U.S. Pat. No. 5,082,225 describes a clip which allows sunglasses to be attached to the visor of a cap. An different style clip is described in U.S. Pat. No. 5,975,476, intended to attach glasses to a visor. Both of these inventions suffer, in comparison to the current invention, in that they require a separate clip, not normally carried or worn by the wearer of the glasses, which is easily misplaced.

The current invention, besides being extremely inexpensive, has a number of advantages over the prior art. Most importantly from a functional standpoint, the holder is integrated into the wearer's hat, and cannot be misplaced or lost. Furthermore, the appearance of the present invention is attractive and pleasing to the eye, the glasses blending in with the cap visor without extraneous clips or clamps to disturb the line of the cap.

SUMMARY OF THE INVENTION

It is an object of the present invention to provide a modified cap with means to securely carry sunglasses while not in use by the wearer. It is a further object of this invention to provide such means in a simple, unobtrusive manner, in which the glasses may be easily attached and removed.

In accordance with one aspect of the current invention, a cap with integral eyeglass holder includes a bill, and an elastic band, having a first end and a second end. Each of these ends is attached in proximity to the bill, forming a loop into which the eyeglass is inserted.

In accordance with a second aspect of the invention, the bill has a superior surface and a inferior surface, and the elastic band is attached to the superior surface.

In accordance with a third aspect of the invention, the bill has a anterior edge and a posterior edge, and the first end of the elastic band is attached in proximity to the anterior edge of the bill while the second end of the elastic band is attached in proximity to the posterior edge of the bill.

In accordance with a fourth aspect of the invention, the first end of the elastic band is attached to the inferior surface of the bill.

In accordance with a fifth aspect of the invention, the cap further contains a seam between the bill and a cap body, and the second end of the elastic band is attached to said seam.

In accordance with a final aspect of the invention, the elastic band is made of elasticized fabric material.

BRIEF DESCRIPTION OF THE DRAWINGS

These, and further features of the invention, may be better understood with reference to the accompanying specification and drawings depicting the preferred embodiment, in which.

DETAILED DESCRIPTION OF THE PREFERRED EMBODIMENTS

Figure 1:
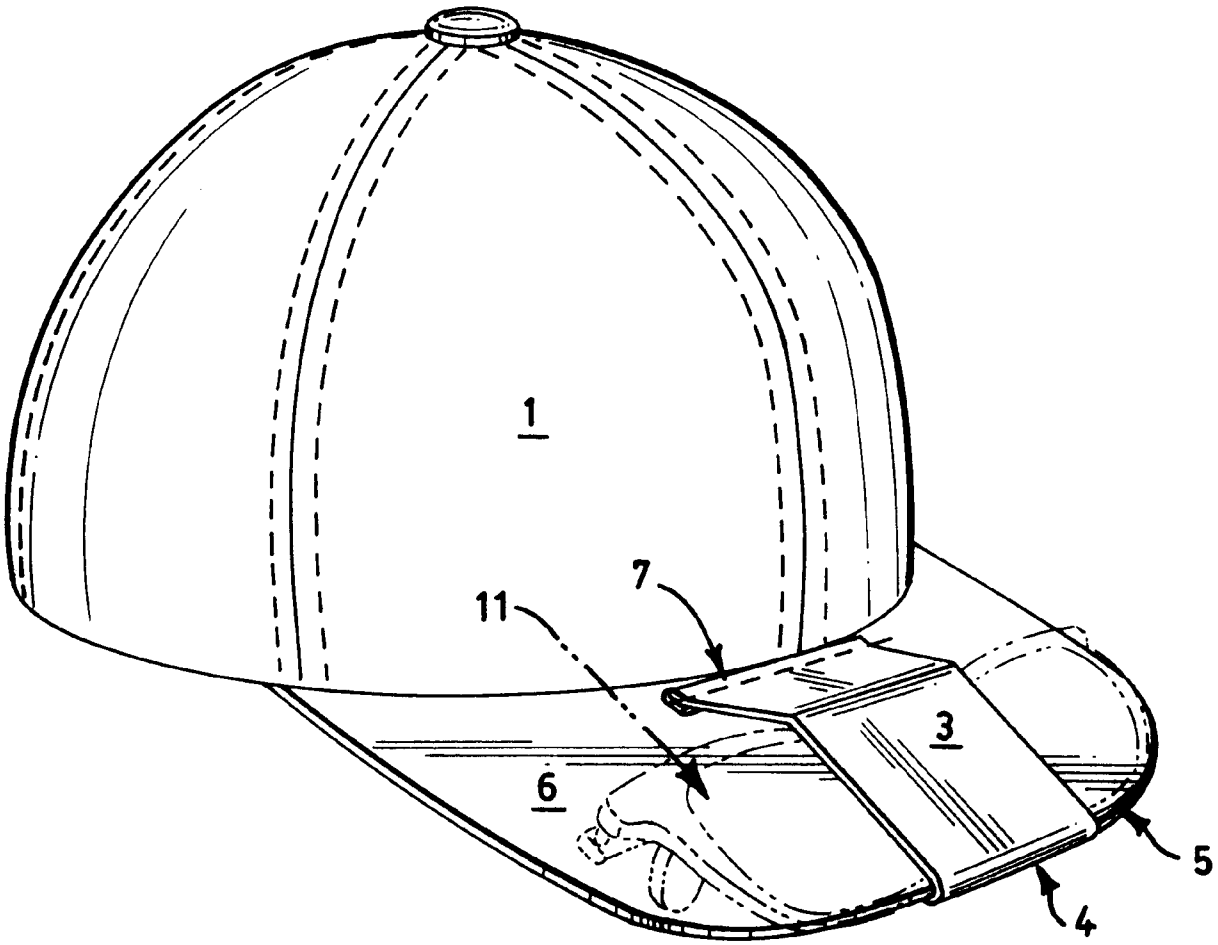
FIG. 1 depicts a perspective view of the invention.

Referring to FIG. 1, the cap includes a body 1, and a bill, on which a band 3 is attached. In its preferred embodiment, the band is of elasticized fabric, of a width of 1⅞ inches.

Figure 2:
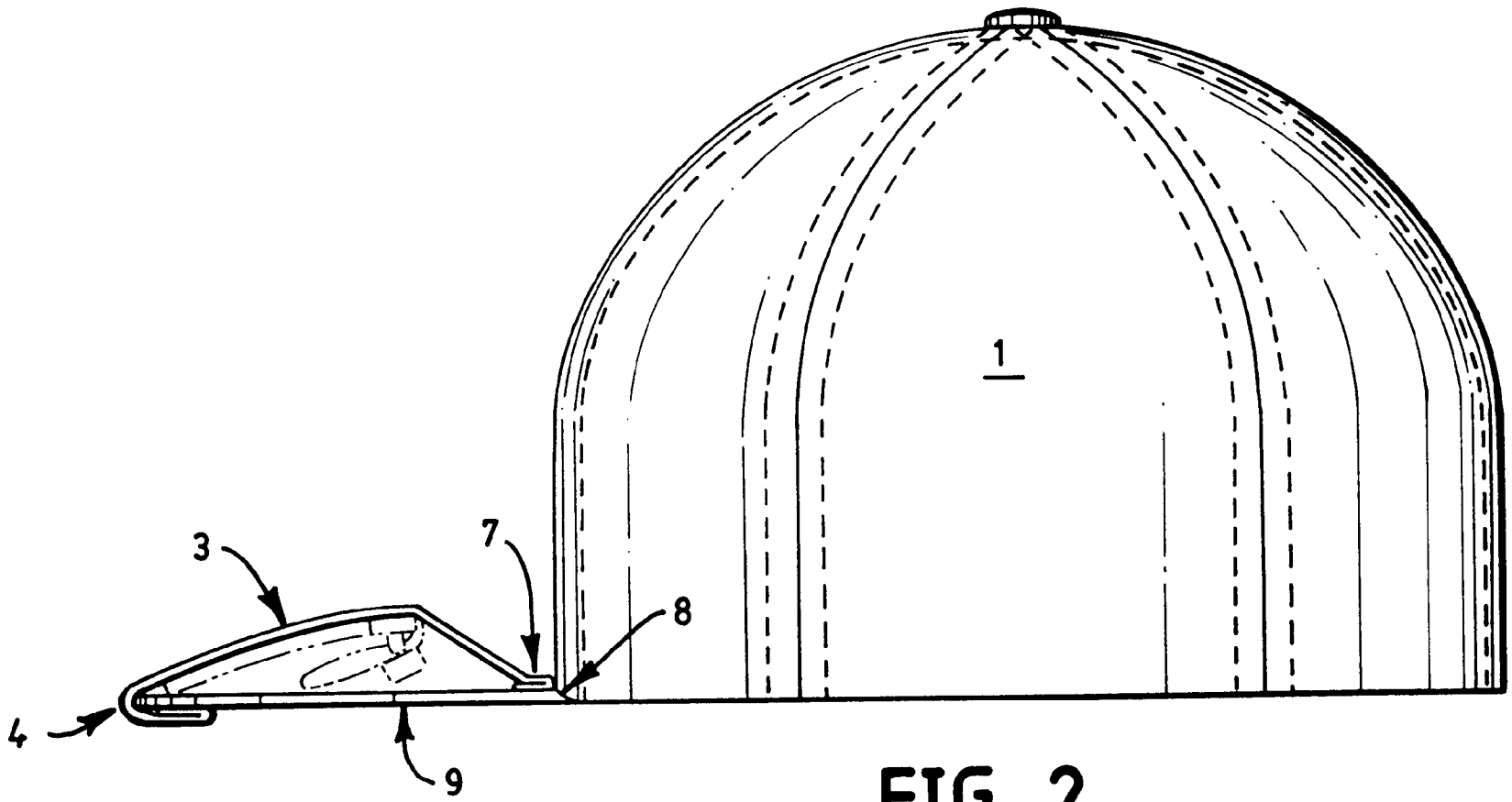
FIG. 2 depicts a side elevation view of the invention.
Figure 3:
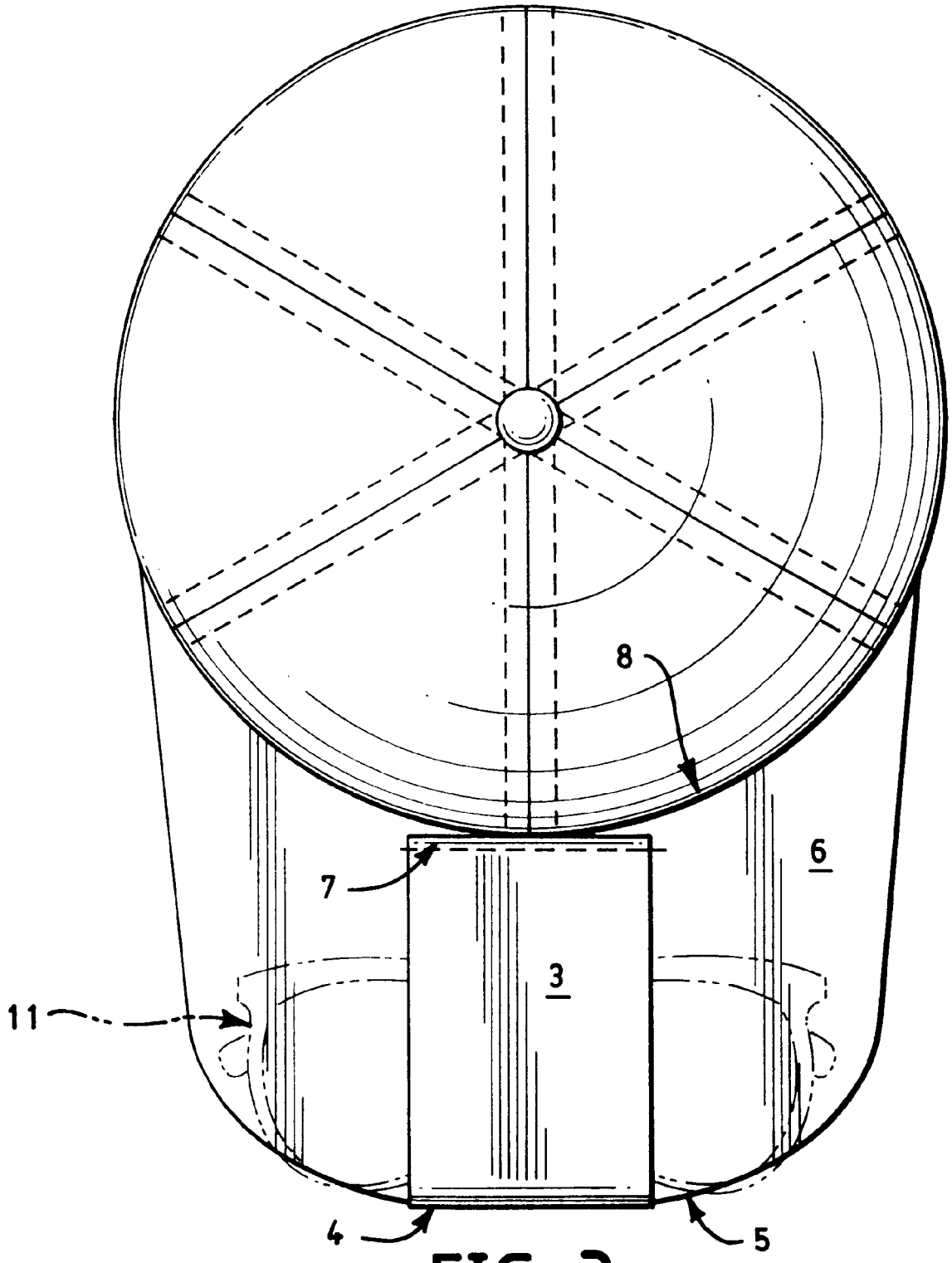
FIG. 3 depicts a plan view of the invention, viewed from above the cap.
Figure 4:
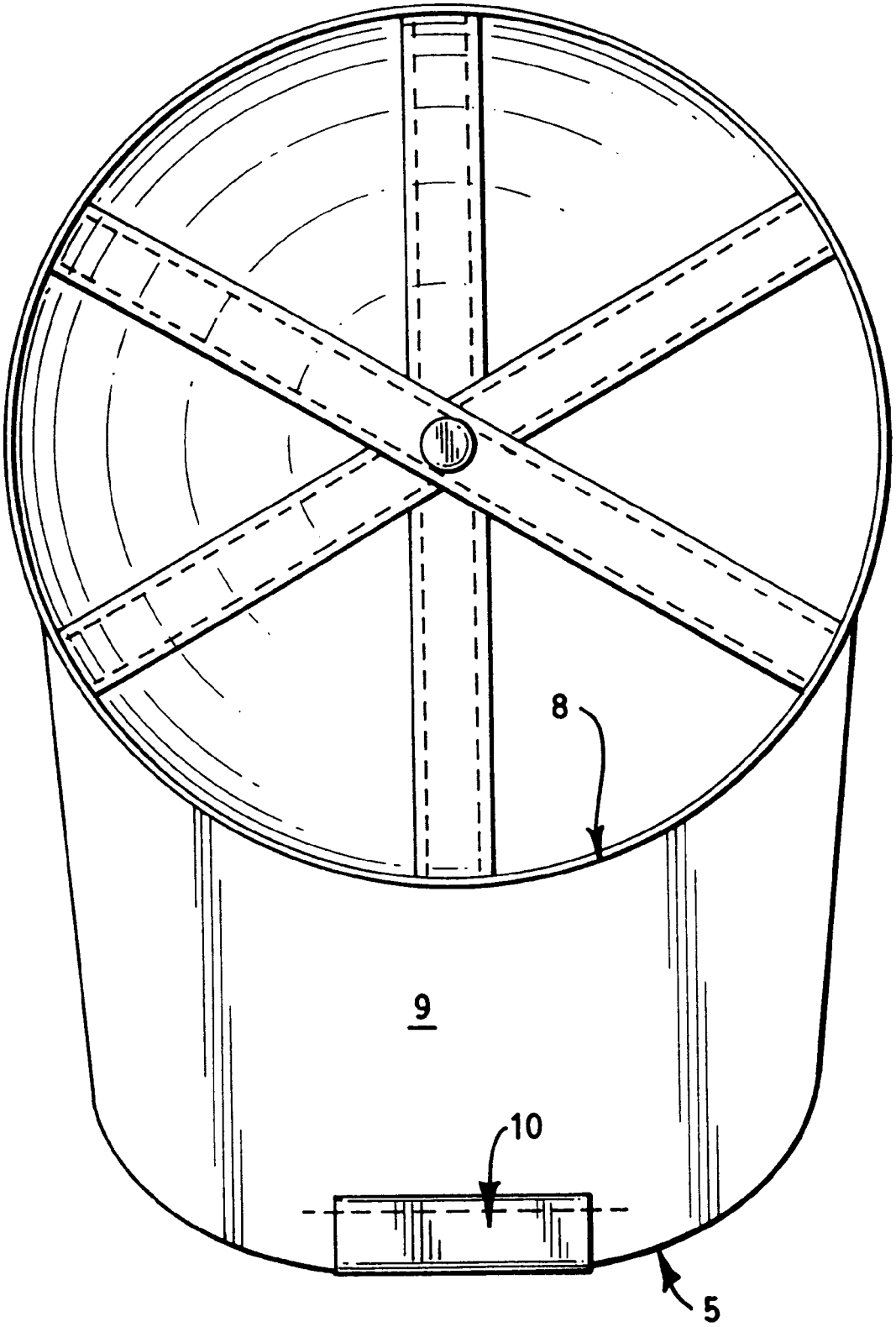
FIG. 4 depicts a plan view of the invention, viewed from below the cap.

Referring to FIGS. 1,2, and 3, it is seen that the band lies on the upper, or superior surface 6 of the bill, as shown. The band has an first end 4, which is folded over the anterior end of the bill 5 as shown, and doubled into a front attachment tab 10, which is sewn onto the lower, or inferior surface 9 of the bill. The attachment tab is best viewed in FIG. 4, a plan view as seen from below the cap. The second end 7 of the band is also folded over, to produce a smooth hem, which is then sewn near the junction between the body 1 and the posterior edge of the bill 8. In the preferred embodiment, the first end of the band extends approximately ⅝ inches onto the inferior surface of the bill, and is stitched for a distance of about 1⅞ inches, at a distance of ⅜ inches from the anterior edge of the bill.

The band is slightly stretched when attached without the glasses 11, so that it lies flat upon the superior surface of the bill, and is thus unobtrusive, giving the same appearance as an ordinary billed cap.

An elasticized band of approximately 1⅞ inches has been found to produce the best results when used as described herein. When the glasses 11 are inserted, the pressure of the band is sufficient to firmly restrain the glasses, even when the user engages in activities such as running and jumping. Note that the glasses are not part of this invention, and are shown in the attached figures only for convenience.

Because most sunglasses have a convex shape when folded, the preferred position when inserted is with the lenses up, as shown in FIG. 1.

Alternative methods exist for attaching the band to the bill. These include gluing, riveting, stapling, and other assorted fastening techniques.

This invention may be used for other types of glasses, including magnifying glasses, prescription glasses, goggles, and the like.

While the invention has been described with reference to specific embodiments, it will be apparent that improvements and modifications may be made within the purview of the invention without departing from the scope of the invention defined in the appended claims.

I claim:

1. A cap with integral eyeglass holder, comprising:

a bill, further comprising a superior surface and a inferior surface; and an elastic band, attached to the superior surface, having a first end and a second end, each of which is attached in proximity to the bill; forming a loop into which the eyeglass is inserted.

2. The cap of claim 1, wherein the bill has a anterior edge and a posterior edge, and wherein the first end of the elastic band is attached in proximity to the anterior edge of the bill, and the second end of the elastic band is attached in proximity to the posterior edge of the bill.

3. The cap of claim 2, wherein the first end of the elastic band is attached to the inferior surface of the bill.

4. The cap of claim 3, wherein the cap further comprises a seam between the bill and a cap body, and wherein the second end of the elastic band is attached in proximity to said seam.

5. The cap of claim 4, wherein the elastic band further comprises elasticized fabric.

* * * * *